US006240740B1

(12) United States Patent
Endo et al.

(10) Patent No.: US 6,240,740 B1
(45) Date of Patent: Jun. 5, 2001

(54) INDOOR UNIT FOR AN AIR CONDITIONER

(75) Inventors: Teruyoshi Endo; Tamaki Kawakami; Yoshinori Tanikawa; Kunio Matsushita, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/449,744

(22) Filed: Nov. 26, 1999

(30) Foreign Application Priority Data

Nov. 27, 1998 (JP) ..... 10-337116
Mar. 25, 1999 (JP) ..... 11-081427

(51) Int. Cl.[7] ..... F25D 21/14
(52) U.S. Cl. ..... 62/285; 62/288; 62/291
(58) Field of Search ..... 62/285, 288, 290, 62/291

(56) References Cited

U.S. PATENT DOCUMENTS 1,855,432 * 4/1932 Vance ..... 62/271
2,238,543 * 4/1941 Trotter ..... 62/89.6
4,907,420 * 3/1990 Mahanay et al. ..... 62/291
5,481,886 * 1/1996 Hasegawa et al. ..... 62/285
5,499,514 * 3/1996 Ho ..... 62/291
6,065,296 * 5/2000 Feger ..... 62/77

FOREIGN PATENT DOCUMENTS 58-033980 8/1956 (JP) .
6-011148 1/1994 (JP) .
6-032924 4/1994 (JP) .

* cited by examiner

*Primary Examiner*—Michael Powell Buiz
*Assistant Examiner*—Melvin Jones
(74) *Attorney, Agent, or Firm*—Oblon, Spivak, McClelland, Maier & Neustadt, P.C.

(57) ABSTRACT

An air conditioner indoor unit which includes a heat exchanger; a fan; a drain pan provided under the heat exchanger, the drain pan retrieving drain water condensed on the heat exchanger; an outlet nozzle member provided under the drain pan, the outlet nozzle member providing an air path for blowing off air supplied by the fan and a hollow space between the drain pan and the outlet nozzle member; a drain pan drainage formed in the drain pan, the drain pan drainage draining drain water stored in the drain pan; a hollow space drainage formed in the outlet nozzle member at a location close to the drain pan drainage, the hollow space drainage draining drain water stored in the hollow space; and a drain hose connected to the drain pan drainage and the hollow space drainage.

16 Claims, 15 Drawing Sheets

(a)

(b)

A > B

INDOOR UNIT FOR AN AIR CONDITIONER

BACKGROUND OF THE INVENTION

1. Field of the Invention

The present invention relates to an improvement in the assembly operation, a reduction in the cost of and an improvement in the environmental issue of an air conditioner.

2. Discussion of the Background

In FIG. 24 is shown a part of a conventional air conditioner, which includes a drain pan having a hollow space therein for thermal insulation, and which has been disclosed in JP-A-611148 for instance. The conventional air conditioner decreases the amount of a thermal insulation material to reduce fabrication steps, and the drain pan 24 is prepared so as to include an outer layer 25 made of ABS resin and the hollow space 26 formed therein by known gas injection molding.

The function of the drain pan will be explained as follows. In general, the inner side 28 of the drain pan 24 has the tendency to have a lower surface temperature than the outer side 27 since the inner side is close to a heat exchanger and contacts cooled droplets. However, the gas in the hollow space 26 inside the outer layer 25 has a superior thermal insulation property. Even if there is a temperature difference between the inner side 28 and the outer side 27, the gas in the hollow space 26 shuts off the heat transfer therebetween. By this arrangement, the air close to the outer side 27 is not noticeably cooled and vapor condensation is not provided on the outer side 27.

In FIG. 25 is shown a conventional plug arrangement for an air conditioner drain pipe, which has been disclosed in JP-A-58-33980 for instance, which is shown in exploded fashion. In this Figure, reference numeral 101 designates a drain pan, reference numeral 102 designates a drain pipe, which is connected to the drain pan so as to pass therethrough, and reference numeral 103 designates a blind plug to be mounted to the drain pipe for clogging the drain pipe.

The function of the blind plug will be explained as follows. Referring to FIG. 25, the drain pipe 102 is inserted in the drain pan 101 to be engaged therewith, and the blind plug 103 is forcibly capped on the drain pipe 102 to be engaged therewith.

In FIG. 26 is shown an exploded perspective view of essential portions of another conventional plug arrangement for a drain pipe, in FIG. 27 is shown a cross-sectional view to explain how a drain pipe joint is mounted, in FIG. 28 is shown a perspective view of the rain pipe joint, and in FIG. 29 is shown cross-sectional view to explain how a blind plug is mounted. In FIG. 30 is shown a perspective view of the blind plug. In these Figures, reference numeral 101 designates a drain pan, reference numeral 102 designates a drain pipe joint, which passes through and is engaged with a hole 101*a* formed in the drain pan 101, reference numeral 102*a* designates a flange of the drain pipe joint 102, reference numeral 102*b* designates the tubular body of the drain pipe joint 101, reference numeral 102*c* designates a stopper, which is provided on an end of the tubular body of the joint and has a leading edge provided with a conical portion, and reference numeral 102*d* designates a through hole in the drain pipe joint.

If the drain pipe joint 102 is not needed, the blind plug 103 is inserted into the hole 101*a* in the drain pan 101 to be engaged therewith as shown in FIG. 29. If the joint is needed, the joint 102 is inserted into the hole 101*a* in the drain pan 101 to be engaged therewith as shown in FIG. 27. A hose 104 for leading drain water to outside is engaged with the joint 102 as shown in FIG. 31 to drain the water from the drain pan to outside through the through hole in the joint 102 and the hose.

The drainage for a drain pan thus prepared is used in an air conditioner as in the fashion shown in FIG. 32.

Since the conventional drainage is thus constructed, the blind plug and the joint must be exchanged as required, which takes some time to exchange the parts, or which means that the plural parts are required to be ready all the time, that is wasteful.

Since the conventional air conditioner is configured to be provided with the hollow space by gas injection, the air layer can not be provided so as to have a certain thickness or a greater thickness which means that a great deal of thermal insulation cannot be provided. Costs, such as a molding cost, are required.

From the viewpoint that the environmental issue has been presently discussed, it is recommended that used parts can be easily separated according to type. When an insulation material or a similar member is provided on a lower side of a heat exchanger to prevent secondary air from being sucked, there has been created a problem in that separation of the insulating material for disposal is troublesome.

SUMMARY OF THE INVENTION

It is an object of the present invention to eliminate these problems, and to improve the thermal insulation property of a drain pan.

It is another object of the present invention to provide required parts at a low cost.

It is a further object of the present invention to provide drainage treatment with more reliable fashion.

It is a still further reject of the preset invention to facilitate separation of parts for disposal from the viewpoint of product assessment.

The present invention provides an air conditioner indoor unit comprising a heat exchanger; a fan; a drain pan provided under the heat exchanger, the drain pan retrieving drain water condensed on the heat exchanger; an outlet nozzle member provided under the drain pan, the outlet nozzle member providing an air path for blowing off air supplied by the fan and a hollow space between the drain pan and the outlet nozzle member; a drain pan drainage formed in the drain pan, the drain pan drainage draining drain water stored in the drain pan; a hollow space drainage formed in the outlet nozzle member at a location close to the drain pan drainage, the hollow space drainage draining drain water stored in the hollow space; and a drain hose connected to the drain pan drainage and the hollow space drainage. In accordance with the present invention, the hollow space can work for thermal insulation between the drain pan and the outlet nozzle member to dispense with a thermal insulation material and to eliminate the problem of dew drops due to peeling of a thermal insulation material, carrying out drainage in more reliable fashion.

The drain pan drainage and the hollow space drainage may be provided in concentric fashion so that the drain pan drainage is located inside the hollow space drainage.

The drain pan drainage may have a leading edge provided with a trough-shaped guide. This arrangement can direct the drain water from the drain pan drainage to the drain hose in more reliable fashion.

The drain pan drainage and the hollow space drainage may be combined so as to provide a pair of drainages, and a rubber plug with dual concentric flanges may be provided on the pair of drainages when the drainages are not in use. By this arrangement, both drainages can be closed by the single rubber plug.

The outlet nozzle member and the drain pan may be made of different materials, and the drain pan may be made of polypropylene resin. By this arrangement, the occurrence of a creak between parts due to thermal shrinkage can be restrained.

The heat exchange may have a lower end provided with an insulation member to separate a space under the heat exchanger into a primary side and a secondary side, the drain pan may be provided with a rib, and the insulation member is engaged with the rib. By this arrangement, it is possible to remove the insulation member easily for disposal, facilitating the separation of parts.

The insulation member may have angular holes and slots formed therein, the rib may have projections in a triangular shape alternately provided on both lateral sides thereof, and the angular holes may receive the projections in alternate fashion.

The drain pan may be provided with two ribs, one of ribs may have a lateral side facing the other rib provided with projections in a triangular shape, the insulation member may have angular holes formed therein, and the insulation member may be inserted into a gap between the ribs with the ribs fitted into the angular holes.

The drain pan may include an additional drainage, which has a drain pipe joint inserted thereinto. The drain pipe joint may comprise a tubular body with a bore formed therein, a stopper provided on one end of the tubular body and having a conical leading edge, a flange provided on the tubular body at a location close to the stopper, and a wall provided on the other end of the tubular body to close the bore. This arrangement can carry out an operation for connecting a drain hose in effective fashion, and offer an advantage in that the number of required parts is reduced.

The drain pipe joint may be formed from an elastic material. The drain pipe joint can work as a joint and a blind plug in a single use, offering an advantage in that the number of required parts is reduced.

The drain pipe joint may have a cutting groove provided thereon at a location close to the wall. The single drain pipe joint can work as a joint and a blind plug in a single use, offering an advantage in that the number of required parts is reduced.

The wall of the drain pipe joint may be made of a breakable material so that the wall can be broken when the joint is used for drainage. The drain pipe joint can work as a joint and a blind plug in a single use, offering advantages in that the number of required parts is reduced and that an operation for connecting a connecting hose can be simplified.

The drain pan may include an additional drainage with a drain pipe joint inserted thereinto, and the drain pipe joint may comprise a tubular body with a bore formed therein, a stopper provided on one end of the tubular body and having a conical leading edge, a flange provided on the tubular body at a location close to the stopper, and a wall provided on the one end of the tubular body to close the bore. This arrangement can attach the drain pipe joint to the drain pan from inside the drain pan, simplifying the attaching operation.

The drain pipe joint may have a connecting portion with a connecting hose formed so as to have a larger outer diameter than an inner diameter of the connecting hose. This arrangement can ensure that the connecting hose is connected to the joint after the wall has been broken.

The drain pipe joint is configured so as to be attachable to the drain pan from inside the drain pan. This arrangement can offer an advantage in that the attaching operation in a narrow space is simplified.

DESCRIPTION OF THE PREFERRED EMBODIMENT

Figure 1:
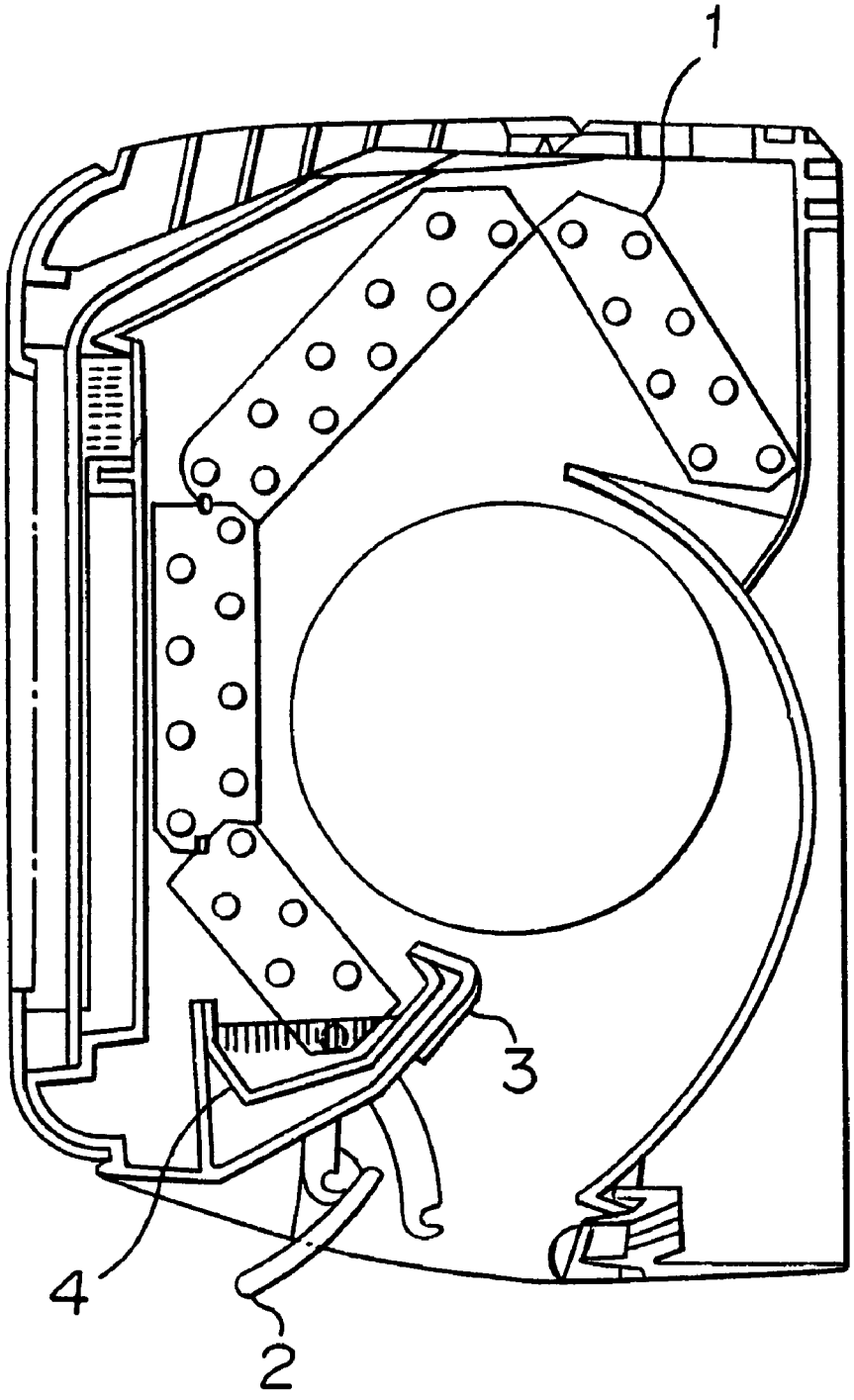
FIG. 1 is a cross-sectional view of essential portions of the air conditioner according to a first embodiment of the present invention.

Now, preferred embodiments of the present invention will be described in detail, referring to the accompanying drawing.

EMBODIMENT 1

A first embodiment of the present invention will be explained, referring to the drawings.

Figure 2:
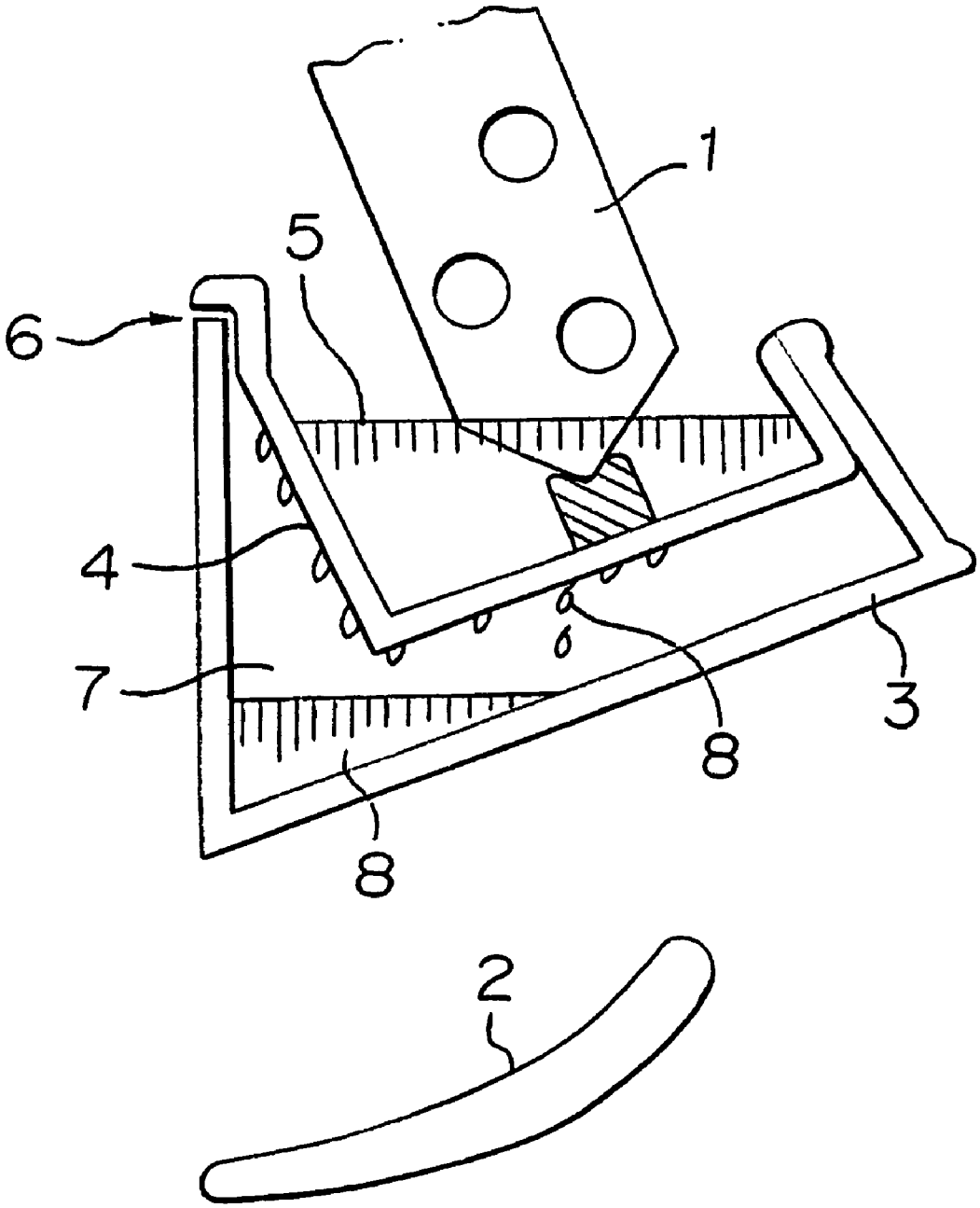
FIG. 2 is a cross-sectional view of essential portions of the air conditioner according to the first embodiment.
Figure 3:
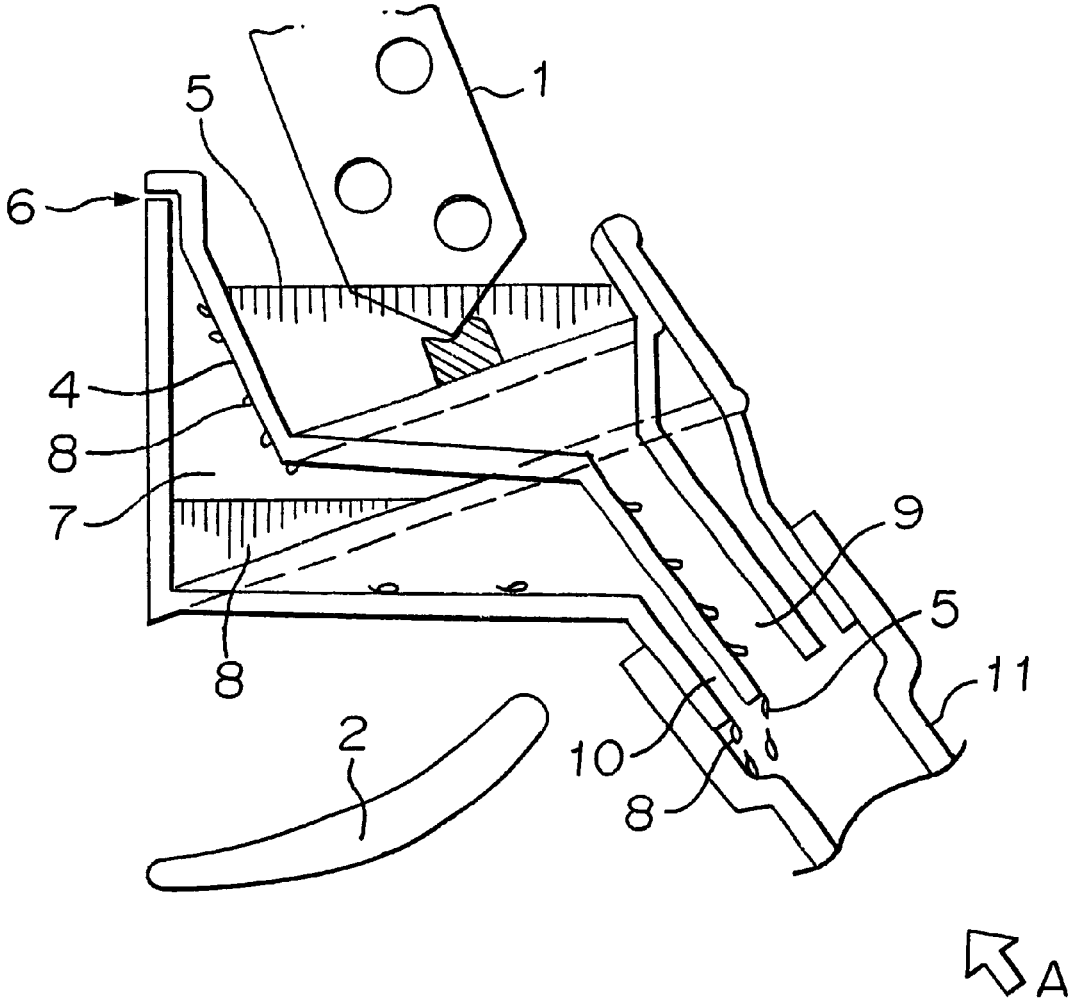
FIG. 3 is a cross-sectional view of essential portions of the air conditioner according to the first embodiment.
Figure 4:
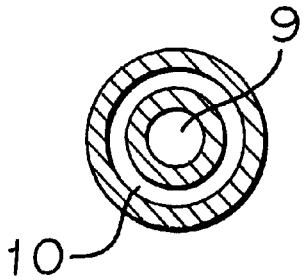
FIG. 4 is a front view of essential portions of the air conditioner according to the first embodiment as viewed from the direction indicated by an arrow A in FIG. 3.

In FIGS. 1 through 4 is shown the first embodiment. In FIG. 1 is shown a cross-sectional view of a wall-hung air conditioner as a whole, in FIGS. 2 and 3 are shown cross-sectional views of essential portions of the air conditioner, and in FIG. 4 is shown a front view of essential portions of the embodiment. In these Figures, reference numeral 1 designates a heat exchanger, reference numeral 2 designates a flap, reference numeral 4 designates a drain pan, reference numeral 5 designates drain water that has moved from the heat exchanger 1 and has been stored in the drain pan, reference numeral 3 designates an outlet nozzle member that is fitted on the drain pan to be combined therewith, reference numeral 8 designates drain water that has been stored in a hollow space 7 due to vapor condensation, reference numeral 9 designates a first drainage as a drain pan drainage for the drain water 5 in the drain pan 4, and reference numeral 10 designates a second drainage as a hollow space drainage that is provided so as to be concentric with the first drainage 9 and drains the drain water 8 in the hollow space. The drain water in the drain pan and the hollow space is retrieved by a drain hose 11.

The function of the device according to this embodiment will be explained. An outlet nozzle of the air conditioner is provided by the drain pan 4 and the outlet nozzle member 3 fitted on and combined with the drain pan. The drain water 5 that has been stored in the drain pan 4 is drained through the first drainage 9. Since the hollow space 7 defined by the drain pan 4 and the outlet nozzle member 3 has air leaked thereinto through a gap 6 between the drain pan and the outlet nozzle member, the drain water 8 is deposited on the inner wall of the hollow space 7, and the drain water is stored in the hollow space 7. As shown in FIG. 4, the second drainage 10 for the drain water 8 in the hollow space 7 is provided so as to be concentric with the first drainage 9 to retrieve the drain water 8 in the hollow space 7 together with the drain water 5 in the drain pan through the single drain hose 11, preventing the drain water 8 in the hollow space 7 from overflowing the hollow space or dropping out of the hollow space.

Since no foamed material or a similar material is used, it is possible to disengage the outlet nozzle member 3 from the drain pan 4 easily, and therefore to carry out separation of the parts simply for disposal.

Although the second drainage 10 for the drain water 8 in the hollow space 7 is shown to be concentric with the first drainage 9 for the drain pan 4, the second drainage is not limited to the concentric fashion as long as the second drainage is located close to the first drainage 9.

According to this embodiment, the hollow space can be provided so as to offer a required thermal insulation by the two parts.

No use of a thermal insulation material eliminates the problem of dew drops due to peeling of a thermal insulation material, and drainages treatment can be carried out in more reliable fashion. This embodiment can offer an advantage in that the device can be provided at a low cost. The disengagement of the parts is easy to improve the separation of the parts for disposal.

EMBODIMENT 2

Figure 5:
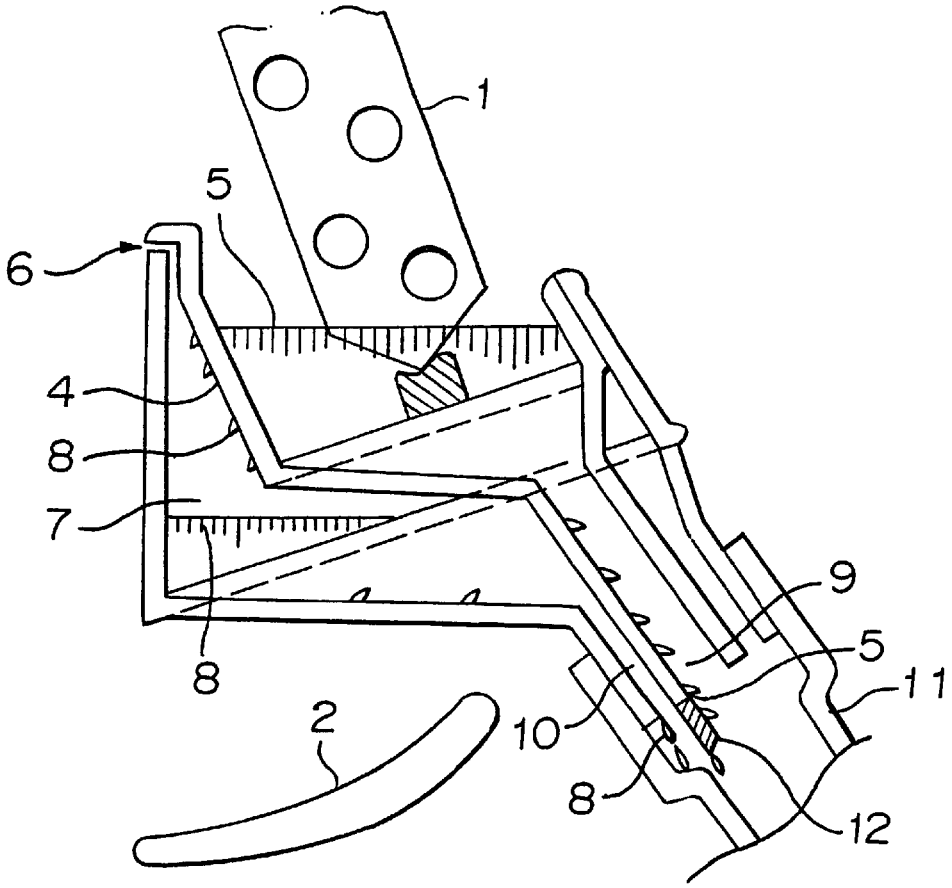
FIG. 5 is a cross-sectional view of essential portions of the air conditioner according to a second embodiment of the present invention.

In FIG. 5 is shown a cross-sectional view of essential portions of the air conditioner according to a second embodiment. In this Figure, reference numeral 12 designates a trough-shaped guide, which is provided on a leading edge of the first drainage 9 for the drain water 5 in the drain pan 4. The trough-shaped guide 12 can be provided to the leading edge of the first drainage 9 for the drain water 5 according to the first embodiment to reliably direct the drain water 5 to the drain hose 11 without allowing the drain water 5 to flow into the hollow space 7 even if the leading edges of the first and second drainages 9 and 10 are located at the same projecting position.

EMBODIMENT 3

Figure 6:
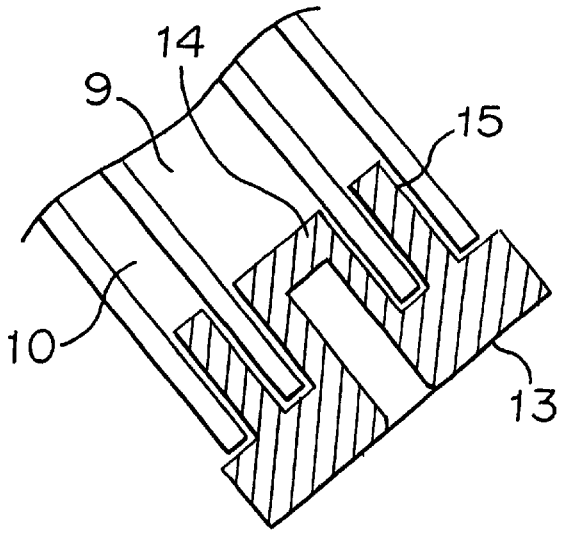
FIG. 6 is a cross-sectional view of essential portions of the air conditioner according to a third embodiment of the present invention.

In FIG. 6 is shown a cross-sectional view of essential portions of the air conditioner according to a third embodiment of the present invention. As shown in this Figure, a rubber plug 13 is used to clog the first drainage 9 and the second drainage 10 that are not in use.

Air conditioners are usually provided with drainages at two locations. One of the drainages is ready for use on installation, and the drainage that is not in use is clogged with a rubber plug.

The rubber plug 13 can be provided with concentric flanges 14 and 15 to clog the respective drainages 9 and 10, thereby clogging both drainages with the single rubber plug.

EMBODIMENT 4

Figure 7:
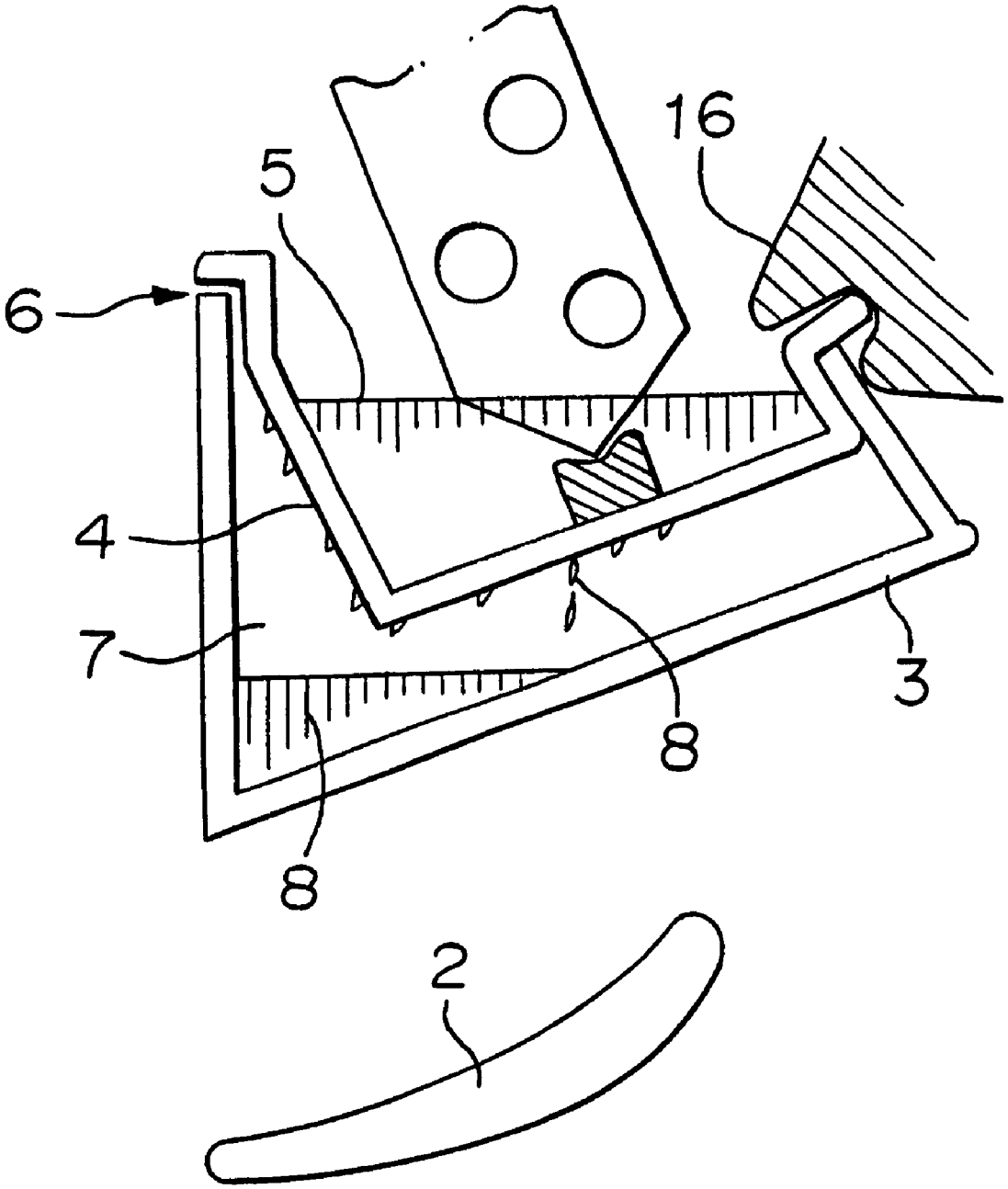
FIG. 7 is a cross-sectional view of essential portions of the air conditioner according to a fourth embodiment of the present invention.

In FIG. 7 is shown a cross-sectional view of essential portion of the air conditioner according to a fourth embodiment of the present invention. In this Figure, reference numeral 16 designates a nozzle fixing portion, which is used to fix the drain pan 4 thereto. The outlet nozzle member 3 and the drain pan 4 are made of different materials, respectively. The drain pan 4 is made of polypropylene, allowing engagement with other parts to be carried out with the presence of the polypropylene material. Due to the presence of the polypropylene material, almost no creaking, which is normally produced between parts due to thermal shrinkage, is generated.

EMBODIMENT 5

Figure 8:
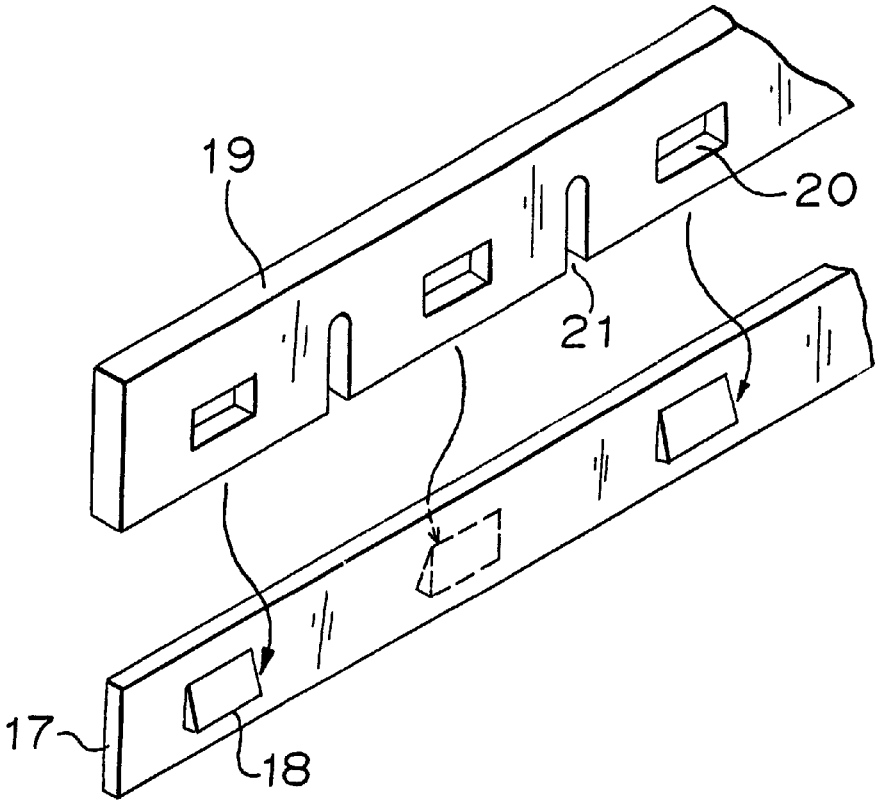
FIG. 8 is a cross-sectional view of essential portions of the air conditioner according to a fifth embodiment of the present invention.
Figure 9:
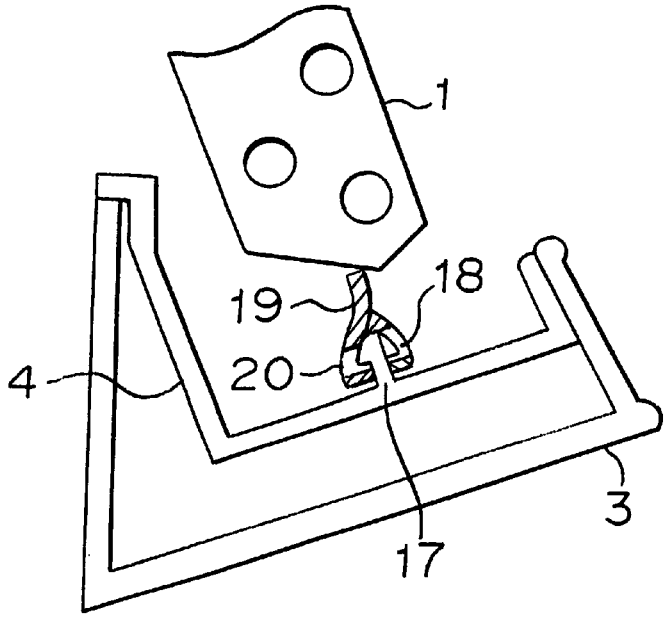
FIG. 9 is a cross-sectional view of essential portions of the air conditioner according to the fifth embodiment.

In FIGS. 8 and 9 are shown a perspective view and a cross-sectional view of essential portions of the air conditioner according to a fifth embodiment of the present invention. In these Figures, reference numeral 17 designates a rib that is provided on the drain pan 4, reference numeral 18 designates projections in a triangular cross-sectional shape, reference numeral 19 designates an insulating member, reference numeral 20 designates a plurality of angular holes formed in the insulating member 19, and reference numeral 21 designates slots.

The insulating member 19, which separates a primary side and a secondary side at a lower end of the heat exchanger 1, has a plurality of angular holes 20 and the plural slots 21 formed therein. The single rib 17 is provided on a side of the drain pan 4 close to the heat exchanger, and the rib has both lateral sides alternately provided with the projections 18 in a triangular cross-sectional shape. The projections 18 are zigzag fitted into the angular holes 20 in the insulating member 19.

Since it is possible to remove the insulating member 19 easily for disposal, the separation of parts can be improved.

In the conventional air conditioner, the insulating member for separating a primary side and a secondary side at a lower end of the heat exchanger is fixed to the drain pan 4 by an adhesive.

EMBODIMENT 6

Figure 10:
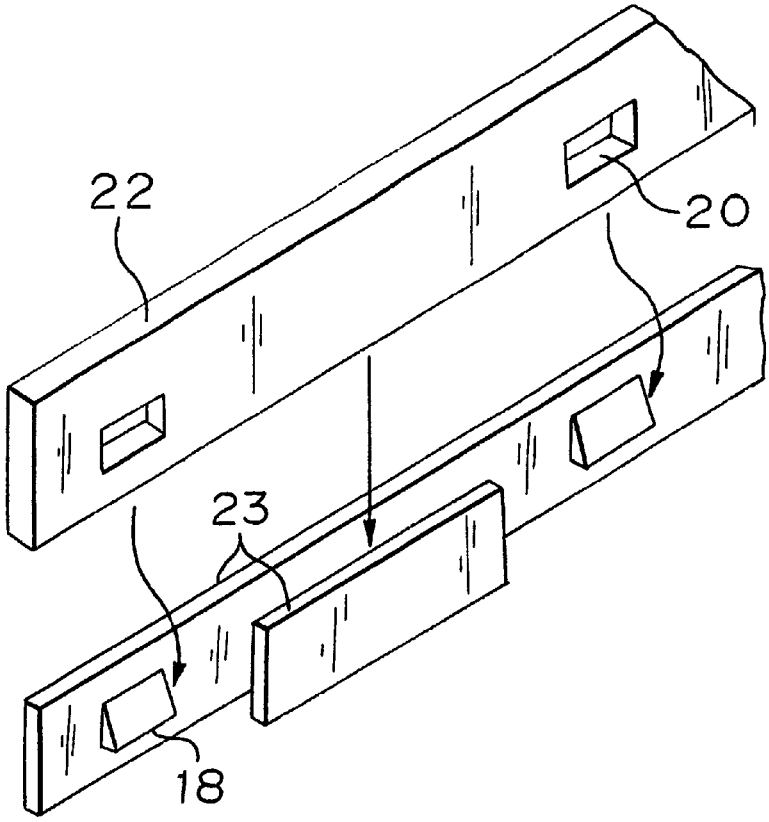
FIG. 10 is a cross-sectional view of essential portions of the air conditioner according to a sixth embodiment of the present invention.
Figure 11:
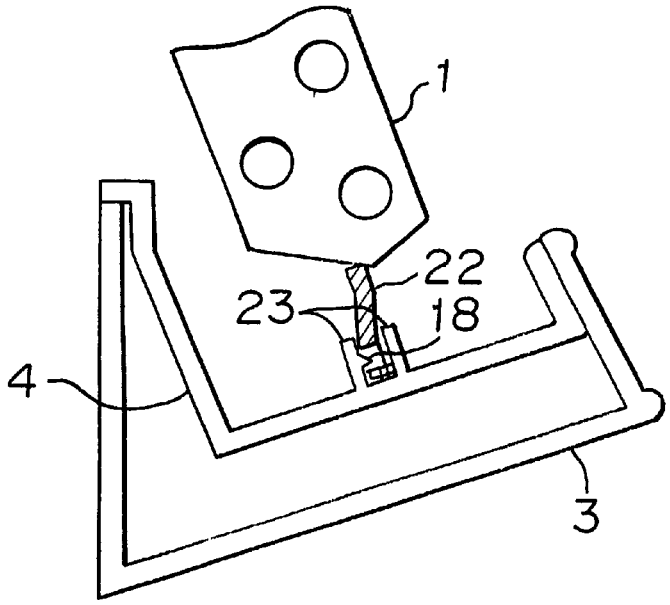
FIG. 11 is a cross-sectional view of essential portions of the air conditioner according to the sixth embodiment.

In FIGS. 10 and 11 are shown a perspective view and a cross-sectional view of essential portions of the air conditioner according to a six embodiment of the present invention. In this Figure, reference numeral 22 designates an insulating member, and reference numeral 23 designates ribs.

The two ribs 23 are provided on the drain pan 4, and one of the ribs has a lateral side close to the other rib provided with a plurality of projections 18 in a triangular cross-sectional shape. The insulating member 22 is fitted between and fixed to the ribs 23, having the projections 18 received in angular holes 20 formed in the insulating member.

As in the fifth embodiment, it is possible to remove the insulating member 22 easily for disposal, thus improving separation of the parts.

In the explanation of the third embodiment, it has been stated that the drain pan of an air conditioner is usually provided with drainages at two locations. In the case wherein the drain pan includes an additional drainage in addition to the drainage 9, drain pipe joints according to the following embodiment are appropriate to the additional drainage.

EMBODIMENT 7

Figure 12:
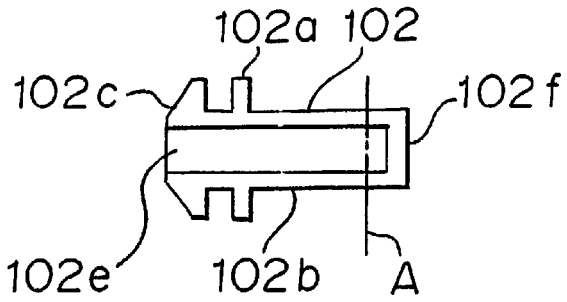
FIG. 12 is a cross-sectional view of the drain pipe joint for an additional drainage in a drain pan according to a seventh embodiment of the present invention.
Figure 13:
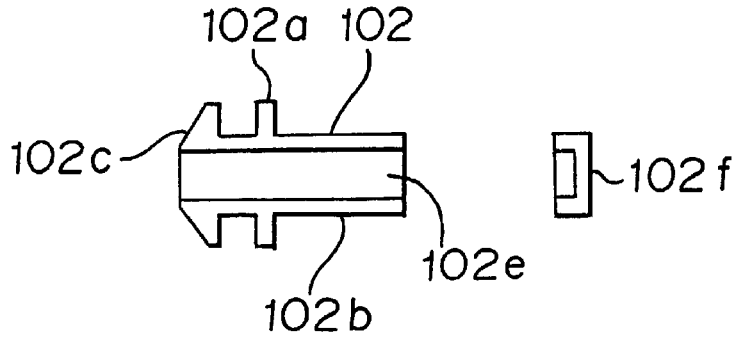
FIG. 13 is a cross-sectional view of the drain pipe joint according to the seventh embodiment, wherein the joint is cut at a line A indicated in FIG. 12.
Figure 14:
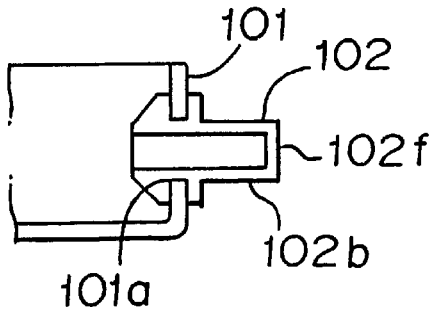
FIG. 14 is a cross-sectional view of the drain pipe joint according to the seventh embodiment, wherein the joint is used as a plug.
Figure 15:
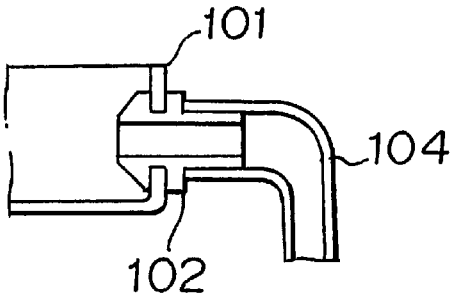
FIG. 15 is a cross-sectional view of the drain pipe joint according to the seventh embodiment, wherein the joint is used for drainage.

Now, the drainage for the drain pan according to a seventh embodiment of the present invention will be explained, referring to the drawings. In FIG. 12 is shown a cross-sectional view of the drain pipe joint according to the seventh embodiment, in FIG. 13 is shown a cross-sectional view of the drain pipe joint as taken along line A shown in FIG. 12, in FIG. 14 is shown a cross-sectional view to explain how the drain pipe joint is used as a drain plug, and in FIG. 15 is shown a cross-sectional view to explain how the drain pan drainage according to the seventh embodiment is used. In these Figures, reference numeral 101 designates the drain pan, reference numeral 102 designates the drain pipe joint, which is inserted into and engaged with a hole 101*a* formed in the drain pan 101, and which is molded from an elastic material, such as rubber, reference numeral 102*a* designates a flange, which is provided on the drain pipe joint 102, reference numeral 102*b* designates a tubular body of the drain pipe joint 102, reference numeral 102*c* designates a stopper, which is provide on an end of the tubular body and has a conical leading edge, reference numeral 102*e* designates a bore in the drain pipe joint 102, and reference numeral 102*f* designates a wall, which is provided on the tubular body at the end remote from the stopper 102*c*.

The function of the drain pipe joint will be explained, referring to FIGS. 12 through 15. The drain pipe joint 102 is engaged with the hole 101*a* formed in the drain pan 101. Since the drain pipe joint 102 has the wall 102*f* provided at the end remote from the stopper, the joint performs a clogging function to prevent drain water from leaking out of the drain pan as shown in FIG. 14, wherein the joint 102 is used as a blind plug. If the drain pipe joint 102 is used as a joint, the drain pipe joint is cut at the position shown in the line A to cut off the wall 102*f* from the tubular body as shown in FIG. 13, and a drain hose 104 is connected to the cut end.

EMBODIMENT 8

Figure 16:
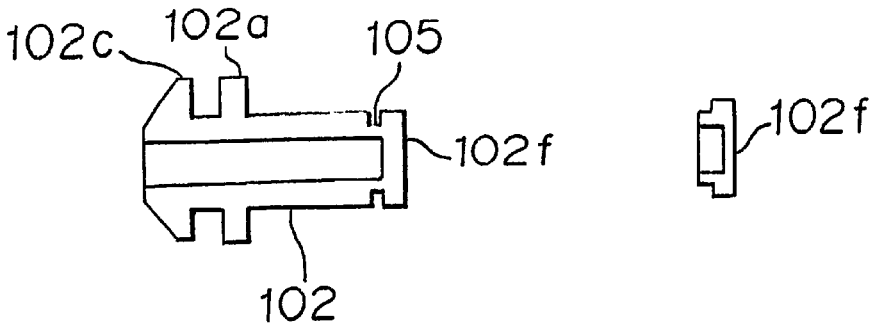
FIG. 16 is a cross-sectional view of the drain pipe joint according to an eighth embodiment of the present invention.

Although the wall 102*f* is cut at the position indicated by the line A of FIG. 12 in the seventh embodiment, the drain pipe joint 102 has a groove 105 provided at an outer periphery thereon at a portion close to the wall 102*f* as a hose connecting portion to clarify the cutting position, allowing the wall to be accurately separated in an eighth embodiment shown in FIG. 16.

EMBODIMENT 9

Figure 17:
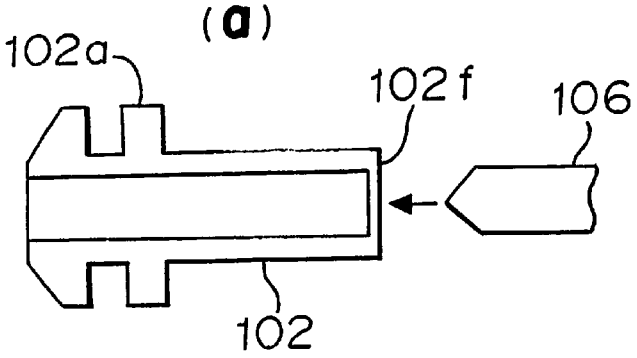
FIGS. 17(*a*) and (*b*) are cross-sectional views of the drain pipe joint according to a ninth embodiment of the present invention.
Figure 17:
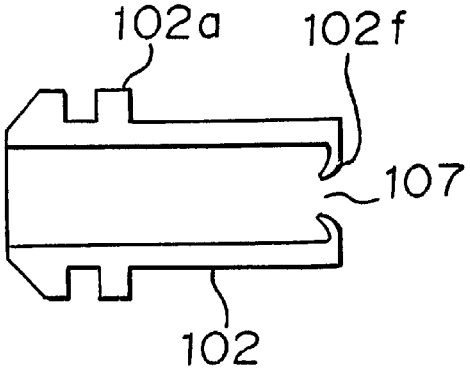

Although the joint has the end close to the wall cut and separated in the seventh and eighth embodiment, the wall 102*f* of the drain pipe joint 102 may be broken by a sharp instrument 106 to form a broken hole 107 as shown in FIGS. 17(*a*) and (*b*), offering a similar effect.

EMBODIMENT 10

Figure 18:
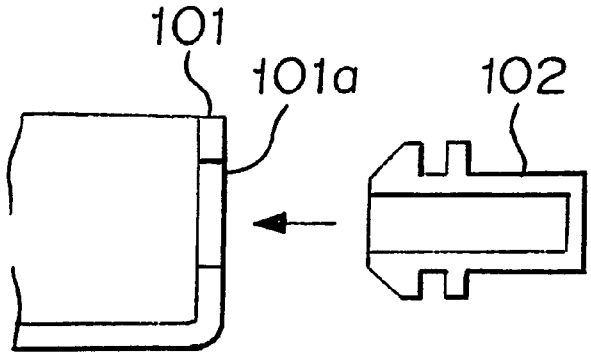
FIG. 18 is a cross-sectional view of the drain pipe joint according to the seventh embodiment to show how to attach the joint into the drain pan.
Figure 19:
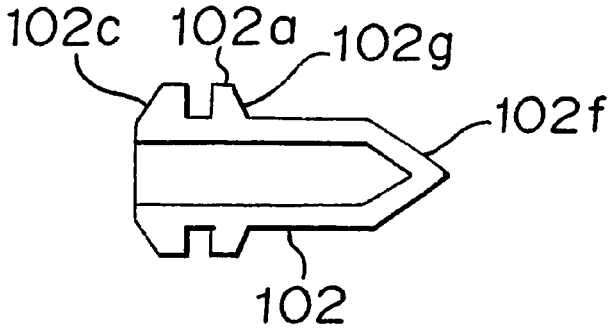
FIG. 19 is a cross-sectional view of the drain pipe joint according to a tenth embodiment of the present invention.
Figure 20:
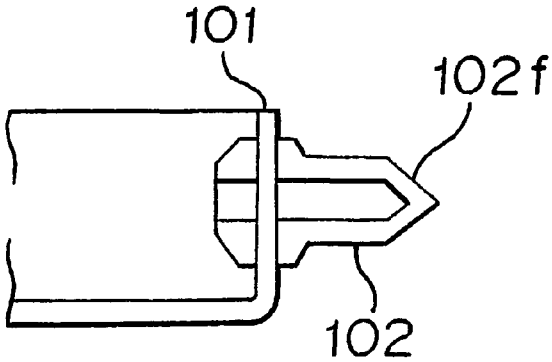
FIG. 20 is a cross-sectional view of the drain pipe joint according to the tenth embodiment to show how to attach the joint into the drain pan.

Although the drain pipe joint 102 according to the seventh through ninth embodiment is inserted into the drain pan 101 from an outer side of the drain pan as shown in FIG. 18, the end of the drain pipe joint 102 with the wall 102*f* is formed in a sharp angular shape and the flange 102*a* has a side provided with a tapered surface 102*g* as shown in FIG. 19. The drain pipe joint 102 is engaged with the hole in the drain pan 101 from an inner side of the drain pan as shown in FIG. 20.

EMBODIMENT 11

Figure 21:
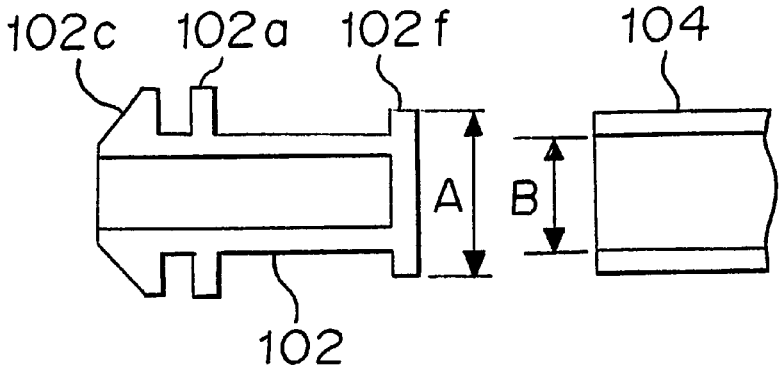
FIG. 21 is a cross-sectional view of the drain pipe joint according to an eleventh embodiment of the present invention.

In FIG. 21 is shown the drain pipe joint for the additional drainage according to an eleventh embodiment, wherein the wall 102*f* of the joint 102 has an outer diameter A formed so as to be larger than the inner diameter B of the connecting hose 104.

EMBODIMENT 12

Figure 22:
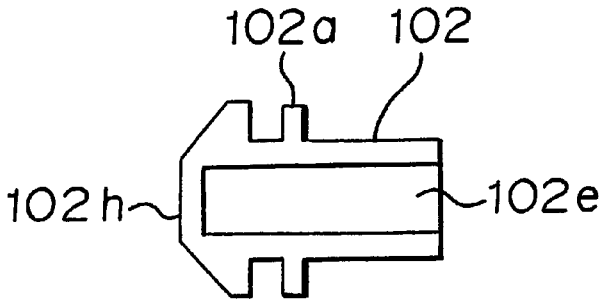
FIG. 22 is a cross-sectional view of the drain pipe joint according to a twelfth embodiment of the present invention.
Figure 23:
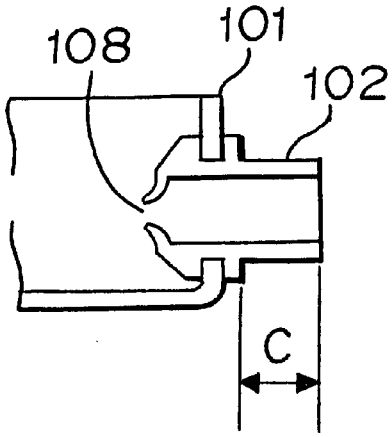
FIG. 23 is a cross-sectional view of the drain pipe joint according to the twelfth embodiment, wherein the joint is used for drainage.
Figure 24:
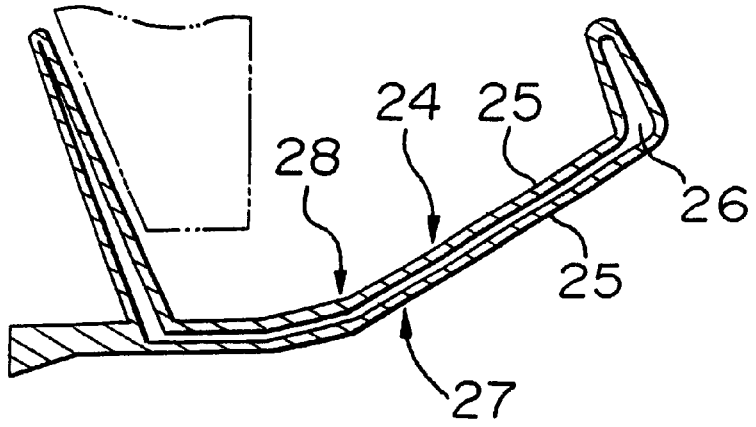
FIG. 24 is a cross-sectional view of a part of a conventional air conditioner.
Figure 25:
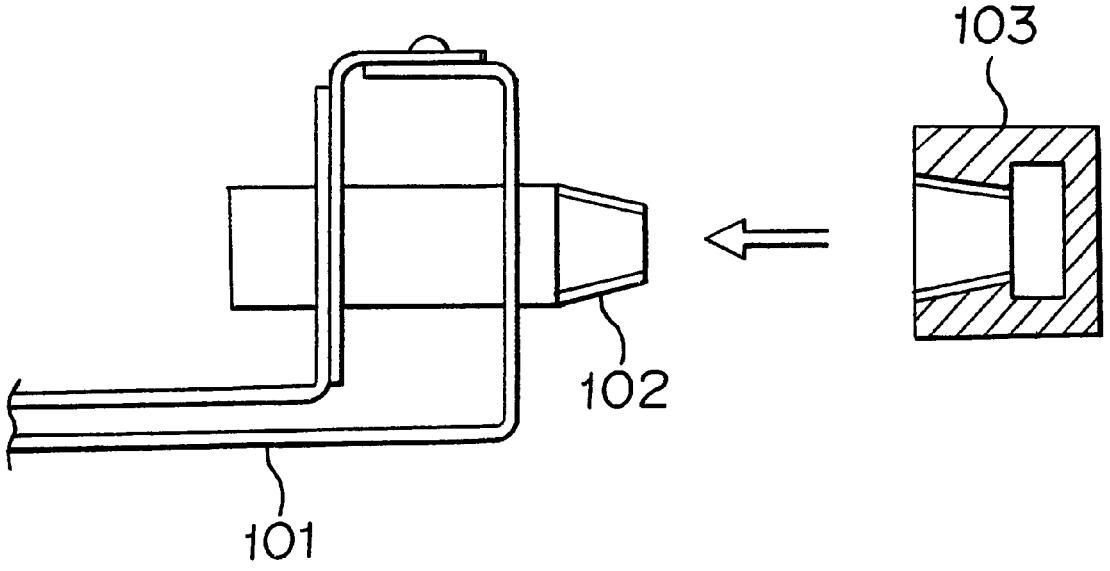
FIG. 25 is an exploded cross-sectional view of a conventional drain pipe plug arrangement.
Figure 26:
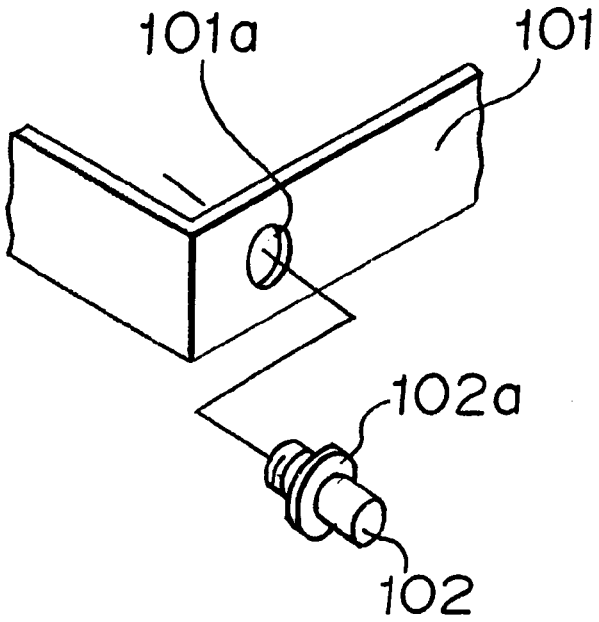
FIG. 26 is an exploded cross-sectional view of another conventional drain pipe plug arrangement.
Figure 27:
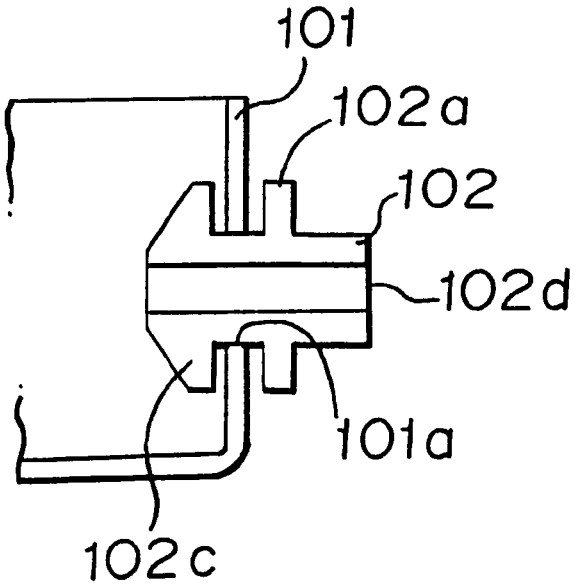
FIG. 27 is a cross-sectional view of a conventional drain pipe joint to show how to attach the joint into the drain pan.
Figure 28:
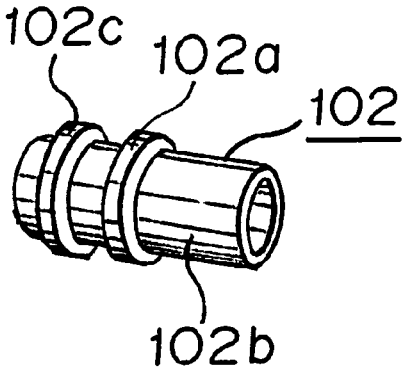
FIG. 28 is a perspective view of the conventional drain pipe joint.
Figure 29:
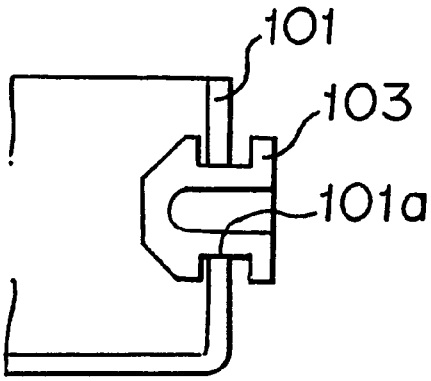
FIG. 29 is a cross-sectional view of a conventional blind plug to show how to attach the plug into the drain pan.
Figure 30:
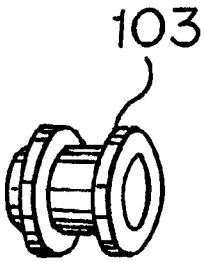
FIG. 30 is a perspective view of the conventional blind plug.
Figure 31:
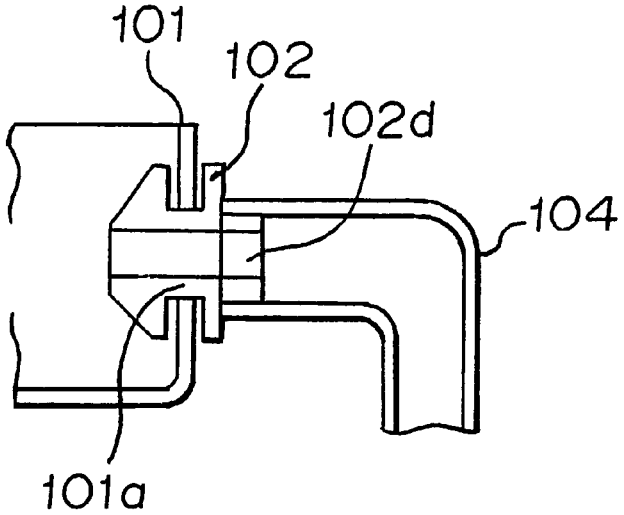
FIG. 31 is a cross-sectional view of the drain pipe joint, wherein the joint is used for drainage.
Figure 32:
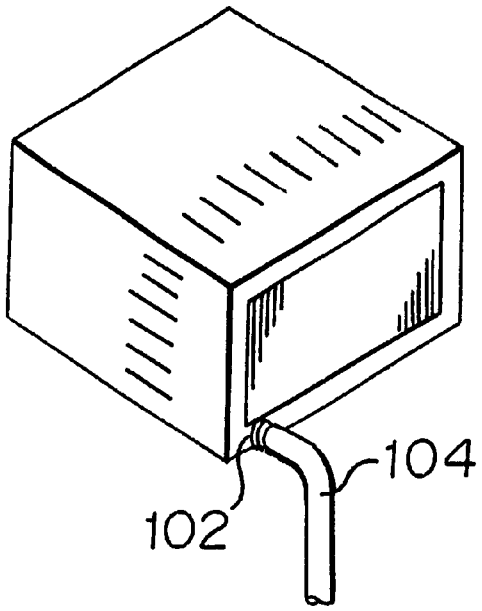
FIG. 32 is a perspective view wherein the conventional drain pipe joint is applied to an air conditioner.

In FIGS. 22 and 23 is shown the drain pipe joint for the additional drainage according to a twelfth embodiment of the present invention. Reference numeral 102*h* designate a wall, which is provided on the drain pipe joint 102 at the end with the stopper 102 so as to close the bore 102*e* at the leading edge of the stopper 102*c*.

When the drain pipe joint according to the twelfth embodiment is used as a drain pipe, the wall 102*h* is broken by an instrument to form a through hole 108, allowing drain water to be drained.

What is claimed is:

1. An air conditioner indoor unit comprising:

a heat exchanger;

a fan;

a drain pan provided under the heat exchanger, the drain pan retrieving drain water which has condensed on the heat exchanger;

an outlet nozzle member provided under the drain pan, the outlet nozzle member providing an air path for blowing off air supplied by the fan and a hollow space between the drain pan and the outlet nozzle member;

a drain pan drainage formed in the drain pan, the drain pan drainage draining drain water stored in the drain pan;

a hollow space drainage formed in the outlet nozzle member at a location in proximity with the drain pan drainage, the hollow space drainage serving to drain water stored in the hollow space and the drain pain drainage being located inside the hollow space drainage; and a drain hose connected to the drain pan drainage and the hollow space drainage wherein the drain pan includes an additional drainage, and the additional drainage has a drain pipe joint inserted thereinto.

2. The and or unit according to claim 1, wherein the drain pipe joint has a connecting portion with a connecting hose formed so as to have a larger outer diameter then an inner diameter of the connecting hose.

3. The indoor unit according to claim 1, wherein the drain pipe joint is configured so as to be attachable to the drain pan from inside the drain pan.

4. The indoor unit according to claim 3, wherein the drain pipe joint is formed from an elastic material.

5. The indoor unit according to claim 3, wherein the drain pipe joint has a cutting groove provided thereon at a location close to the wall.

6. The indoor unit according to claim 3, wherein the wall is made of a breakable material so that the wall can be broken when the joint is used for drainage.

7. An air conditioner indoor unit comprising:

a heat exchanger;

a fan;

a drain pan provided under the heat exchanger, the drain pan retrieving drain water which has condensed on the heat exchanger;

an outlet nozzle member provided under the drain pan, the outlet nozzle member providing an air path for blowing off air supplied by the fan and a hollow space between the drain pan and the outlet nozzle member;

a drain pan drainage formed in the drain pan, the drain pan drainage draining drain water stored in the drain pan;

a hollow space drainage formed in the outlet nozzle member at a location in proximity to the drain pan drainage, the hollow space drainage serving to drain water stored in the hollow space wherein the drain pain drainage is located inside the hollow space drainae; and a drain hose connected to the drain pan drainage and the hollow space drainage.

8. The indoor unit according to claim 7, wherein the drain pan drainage and the hollow space drainage are provided in concentric fashion.

9. The indoor unit according to claim 8, wherein the drain pan drainage has a leading edge provided with a trough-shaped guide.

10. The indoor unit according to claim 8, wherein the drain pan drainage and the hollow space drainage are combined so as to provide a pair of drainages, and a rubber plug with dual concentric flanges is provided on the pair of drainages when the drainages are not in use.

11. An air conditioner indoor unit comprising:

a heat exchanger;

a fan;

a drain pan provided under the heat exchanger, the drain pan retrieving drain water which has condensed on the heat exchanger;

an outlet nozzle member provided under the drain pan, the outlet nozzle member providing an air path for blowing off air supplied by the fan and a hollow space between the drain pan and the outlet nozzle member;

a drain pan drainage formed in the drain pan, the drain pan drainage draining drain water stored in the drain pan;

a hollow space drainage formed in the outlet nozzle member at a location in proximity with the drain pan drainage, the hollow space drainage serving to drain water stored in the hollow space and the drain pain drainage being located inside the hollow space drainage; and a drain hose connected to the drain pan drainage and the hollow space drainage wherein the outlet nozzle member and the drain pan are made of different materials, and the drain pan is made of polypropylene resin.

12. An air conditioner indoor unit comprising:

a heat exchanger;

a fan;

drain pan provided under the heat exchanger, the drain pan retrieving drain water which has condensed on the heat exchanger;

an outlet nozzle member provided under the drain pan, the outlet nozzle member providing an air path for blowing off air supplied by the fan and a hollow space between the drain pan and the outlet nozzle member;

a drain pan drainage formed in the drain pan, the drain pan drainage draining drain water stored in the drain pan;

a hollow space drainage formed in the outlet nozzle member at a location in proximity with the drain pan drainage, the hollow space drainage serving to drain water stored in the hollow space and the drain pain drainage being located inside the hollow space drainage; and a drain hose connected to the drain pan drainage and the hollow space drainage wherein the heat exchanger has a lower end provided with an insulation member to separate a space under the heat exchanger into a primary side and a secondary side, the drain pan is provided with a rib, and the insulation member is engaged with the rib.

13. The indoor unit according to claim 12, wherein the insulation member has a plurality of angular holes and slots formed therein, the rib has projections in a triangular shape alternately provided on both lateral sides thereof, and the angular holes receive the projections in alternate fashion.

14. The indoor unit according to claim 12, wherein the drain panis provided with two ribs, one of ribs has a lateral side facing the other rib provided with projectiots of a substantially triangular shape, the insulation member has angular holes formed therein, and the insulation member is inserted into a gap between the ribs with the ribs fitted into the angular holes.

15. An air conditioner indoor unit comprising:

a heat exchanger;

a fan;

a drain pan provided under the heat exchanger, the drain pan retrieving drain water condensed on the heat exchanger;

an outlet nozzle member provided under the drain pan, the outlet nozzle member providing an air path for blowing off air supplied by the fan and a hollow space between the drain pan and the outlet nozzle member;

a drain pan drainage formed in the drain pan, the drain pan drainage draining drain water stored in the drain pan;

a hollow space drainage formed in the outlet nozzle member at a location in proximity with the drain pan drainage the hollow space drainage serving to drain water stored in the hollow space and the drain pain drainage being located inside the hollow space drainage; and a drain hose connected to the drain pan drainage and the hollow space drainage wherein the drain pan includes an additional drainage, and the additional drainage has a drain pipe joint inserted thereinto, wherein the drain pipe joint comprises a tubular body with a bore formed therein, a stopper provided on one end of the tubular body and having a conical leading edge, a flange provided on the tubular body at a location close to the stopper, and a wall is provided on the one end of the tubular body to close the bore.

16. The indoor unit according to claim 1, wherein the drain pipe joint comprises a tubular body with a bore formed therein, a stopper provided on a first end of the tubular body and having a conical leading edge, a flange provided on the tubular body at a location in proximity with the stopper, and a wall provided on a second end of the tubular body to close the bore.

* * * * *